US011683639B2

(12) United States Patent
Powell

(10) Patent No.: US 11,683,639 B2
(45) Date of Patent: Jun. 20, 2023

(54) SYSTEMS AND METHODS FOR EXPANDING SENSATION USING HEADSET WITH ISOBARIC CHAMBERS

(71) Applicant: Soniphi LLC, Incline Village, NV (US)

(72) Inventor: Wayne J. Powell, Centennial, CO (US)

(73) Assignee: Soniphi LLC, Incline Village, NV (US)

( * ) Notice: Subject to any disclaimer, the term of this patent is extended or adjusted under 35 U.S.C. 154(b) by 0 days.

(21) Appl. No.: 17/548,194

(22) Filed: Dec. 10, 2021

(65) Prior Publication Data

US 2022/0103933 A1 Mar. 31, 2022

Related U.S. Application Data

(63) Continuation of application No. 16/596,496, filed on Oct. 8, 2019, now abandoned.

(51) Int. Cl.
*H04R 1/28* (2006.01)
*H04R 1/10* (2006.01)

(52) U.S. Cl.
CPC ..... *H04R 1/2811* (2013.01); *H04R 1/1016* (2013.01); *H04R 1/1075* (2013.01)

(58) Field of Classification Search
CPC ..... H04R 1/10; H04R 1/227; H04R 1/2811; H04R 29/008; H04R 1/20; H04R 1/22; H04R 1/2803
See application file for complete search history.

(56) References Cited

U.S. PATENT DOCUMENTS 2,689,016 A * 9/1954 Lang ..... H04R 1/22 181/145
3,688,864 A * 9/1972 Guss ..... H04R 1/26 381/186
3,690,405 A * 9/1972 Hance ..... H04R 1/2819 181/155
3,730,291 A * 5/1973 Goeckel ..... H04R 1/2865 181/193
4,008,374 A * 2/1977 Tiefenbrun ..... H04R 9/04 181/146
4,010,361 A * 3/1977 Latterman ..... A63J 17/00 353/1
4,064,966 A * 12/1977 Burton ..... H04R 1/227 181/155
4,783,820 A * 11/1988 Lyngdorf ..... H04R 1/227 381/89

(Continued)

FOREIGN PATENT DOCUMENTS

CH 681843 A5 * 5/1993 ..... H04R 1/227
DE 202011104338 U1 * 12/2011 ..... H04R 1/2873

(Continued)

*Primary Examiner* — Ryan Robinson
(74) *Attorney, Agent, or Firm* — Fish IP Law, LLP

(57) ABSTRACT

A speaker system uses multiple sound chambers having phi ratios to create a dampening effect to filter out incoherent sounds, thus creating an enhanced listening experience that feels very natural to the listener. The speaker system has at least a sound driver, a first sound chamber having a first volume, and a second sound chamber having a second volume that is approximately 1.6 times the first volume. The speaker system can also have a second sound driver, and a third sound chamber having a third volume that is that is approximately 1.6 times the second volume.

4 Claims, 3 Drawing Sheets

(56) References Cited

U.S. PATENT DOCUMENTS 5,092,424 A * 3/1992 Schreiber ..... H04R 1/2842 181/160
5,147,986 A * 9/1992 Cockrum ..... H04R 29/003 181/156
5,327,504 A * 7/1994 Hobelsberger ..... H04R 3/002 381/89
5,461,676 A * 10/1995 Hobelsberger ..... H04R 1/227 381/89
5,475,764 A * 12/1995 Polk ..... H04R 1/2842 381/338
5,561,717 A * 10/1996 Lamm ..... H04R 1/2869 381/89
5,629,502 A * 5/1997 Nakano ..... H04R 1/2842 181/156
5,701,358 A 12/1997 Larsen et al.
5,812,686 A * 9/1998 Hobelsberger ..... H04R 1/2842 381/345
6,144,751 A * 11/2000 Velandia ..... H04R 1/2826 381/345
6,389,146 B1 * 5/2002 Croft, III ..... H04R 1/2842 381/345
6,431,309 B1 * 8/2002 Coffin ..... H04R 1/2819 181/163
6,816,598 B1 11/2004 Budge
7,136,498 B1 * 11/2006 Schott ..... H04R 1/2842 381/351
8,401,197 B2 * 3/2013 Lee ..... H04R 29/008 345/46
8,755,553 B2 * 6/2014 Slotte ..... H04M 1/035 381/345
9,319,767 B2 * 4/2016 Sakaguchi ..... H04R 25/48
9,578,412 B2 * 2/2017 Azmi ..... H04R 1/2826
10,477,299 B2 * 11/2019 Christner ..... H04R 27/00
10,827,248 B2 * 11/2020 Bacon ..... H04R 1/2876
11,076,220 B2 * 7/2021 Adams ..... H04R 1/26
2002/0003888 A1 * 1/2002 Budge ..... H04R 1/2888 381/345
2002/0114484 A1 * 8/2002 Crisco ..... H04R 1/2842 381/345
2005/0111673 A1 * 5/2005 Rosen ..... B60R 11/0217 381/89
2011/0007923 A1 * 1/2011 Kalkman ..... H04R 1/2811 381/345
2019/0182576 A1 * 6/2019 Pierce ..... H04R 1/1016
2020/0077174 A1 * 3/2020 Solis ..... H04R 9/063
2020/0092637 A1 * 3/2020 Strunk ..... H04R 1/403
2021/0195308 A1 * 6/2021 Solis ..... H01F 27/006
2021/0235182 A1 * 7/2021 Ricci ..... H04R 1/1008
2022/0070570 A1 * 3/2022 Zhang ..... H04R 1/22

FOREIGN PATENT DOCUMENTS

FR 2505125 A1 * 7/1966
FR 1446892 A * 11/1982
GB 2122051 A * 1/1984 ..... H04R 1/227
GB 2260464 A * 4/1993 ..... H04R 1/227
GB 2408405 A * 5/2005 ..... H04R 1/2842
JP 2009017485 A * 1/2009
JP 2009017485 A 10/2012
WO WO-2014063820 A1 * 5/2014 ..... H04R 1/2873

* cited by examiner

SYSTEMS AND METHODS FOR EXPANDING SENSATION USING HEADSET WITH ISOBARIC CHAMBERS

This application is a continuation application of, and claims priority to, U.S. patent application Ser. No. 16/596,496, filed Oct. 8, 2019, and titled, "Systems & Methods For Expanding Sensation Using Headset With Isobaric Chambers". All extrinsic materials identified herein are incorporated by reference in their entirety.

FIELD OF THE INVENTION

The field of the invention is speakers.

BACKGROUND

The background description includes information that may be useful in understanding the present invention. It is not an admission that any of the information provided herein is prior art or relevant to the presently claimed invention, or that any publication specifically or implicitly referenced is prior art.

Prior work teaches isobaric chambers for a traditional loudspeaker. For example, U.S. Pat. No. 4,008,374 to Tiefenbrun et al. teaches a bass unit for a loudspeaker system which has a pair of loudspeakers mounted one behind the other in a casing to define a chamber of air therebetween. U.S. Pat. No. 5,701,358 to Larson et al. teach an isobaric loudspeaker for use in audio systems. U.S. Pat. No. 6,816,598 to Budge teaches multiple drivers sealed in an isobaric chamber. However, these designs for a loudspeaker do not teach enhancing a user's listening sensation by using multiple sound chambers to filter out incoherent sounds.

Thus, there is still a need for speaker system having enhanced listening sensation using multiple sound chambers.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

SUMMARY OF THE INVENTION

The inventive subject matter provides apparatus, systems and methods in which a sound emitting device uses multiple sound chambers with phi ratios to create a dampening effect to filter out incoherent sounds, thus creating an enhanced listening experience to the listener.

In some embodiments, the sound emitting device has a first isobaric chamber having a first volume, a second isobaric chamber having a second volume that is between 1.5 times and 1.7 times the first volume, and more preferably, 1.55 times and 1.66 times the first volume, and even more preferably, 1.6 times and 1.64 times the first volume, inclusive. The sound emitting device has a first sound driver that emits sounds into the first isobaric chamber. In some embodiments, the back of the first sound driver emits sounds into the second isobaric chamber. As used herein, "isobaric chamber" means a sound chamber adjacent to a sound driver (i.e., a speaker) and is used interchangeably with "sound chamber" or "chamber" in short.

In some embodiments, the sound emitting device has a third isobaric chamber having a third volume, that is between 1.5 times and 1.7 times the first volume, and more preferably, between 1.55 times and 1.66 times the second volume, and even more preferably, between 1.6 times and 1.64 times the second volume. In some embodiments, the sound emitting device also has a second sound driver, preferably positioned facing in opposite direction to the first sound driver. In preferred embodiments, an air channel fluidly couples the first and third isobaric chambers, so that the air channel is configured to pass sounds issuing from the front of the first driver to the back of the second driver.

It is contemplated that the sound emitting device fits into a headphone. The first and second isobaric chambers and the first sound driver are enclosed within a housing sized and dimensioned to fit within a human ear canal. In preferred embodiments, the first isobaric chamber has a volume of no more than 7 cc, and the first sound driver is no larger than 70 mm in diameter.

In some embodiments, the sound emitting device use the received information to drive a light source. In preferred embodiments, the light source is a laser emitter configured to emit light at between 640 nm and 660 nm. In some embodiments, the light source is a light emitter configured to emit light waves using a pattern of pulses having a frequency between 0.1 Hz and 50 Hz. In preferred embodiments, the pattern of pulses is based upon frequencies included within information used to drive the first sound driver.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1A:
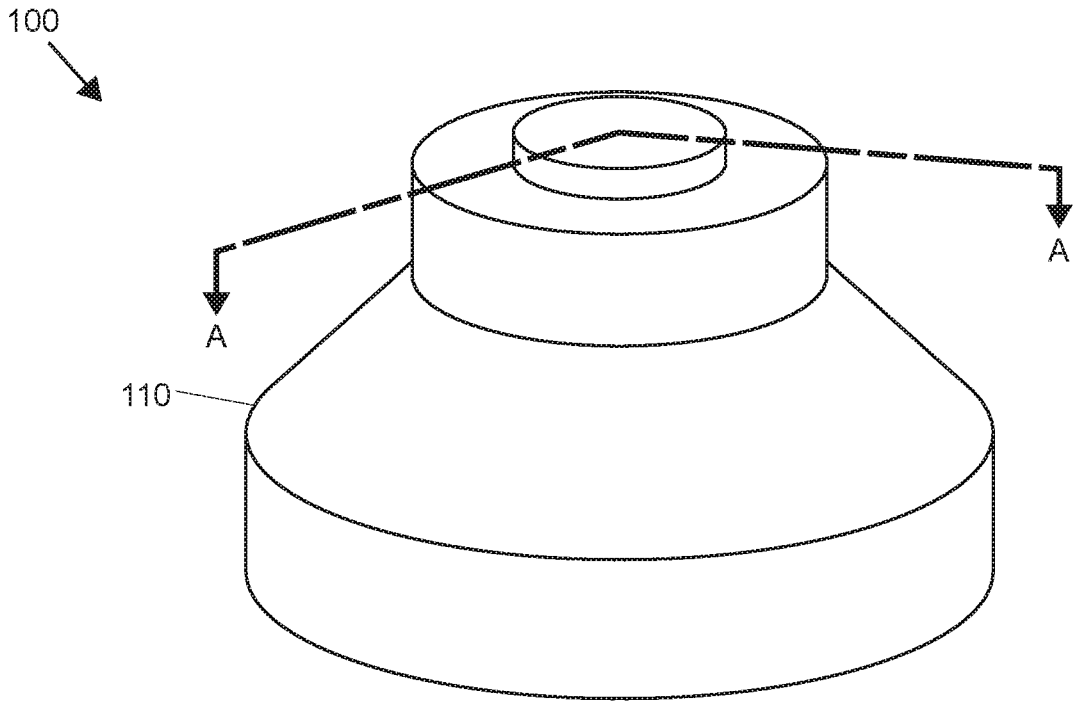
FIG. 1A is a perspective view of an embodiment of a speaker with multiple isobaric chambers.
Figure 1B:
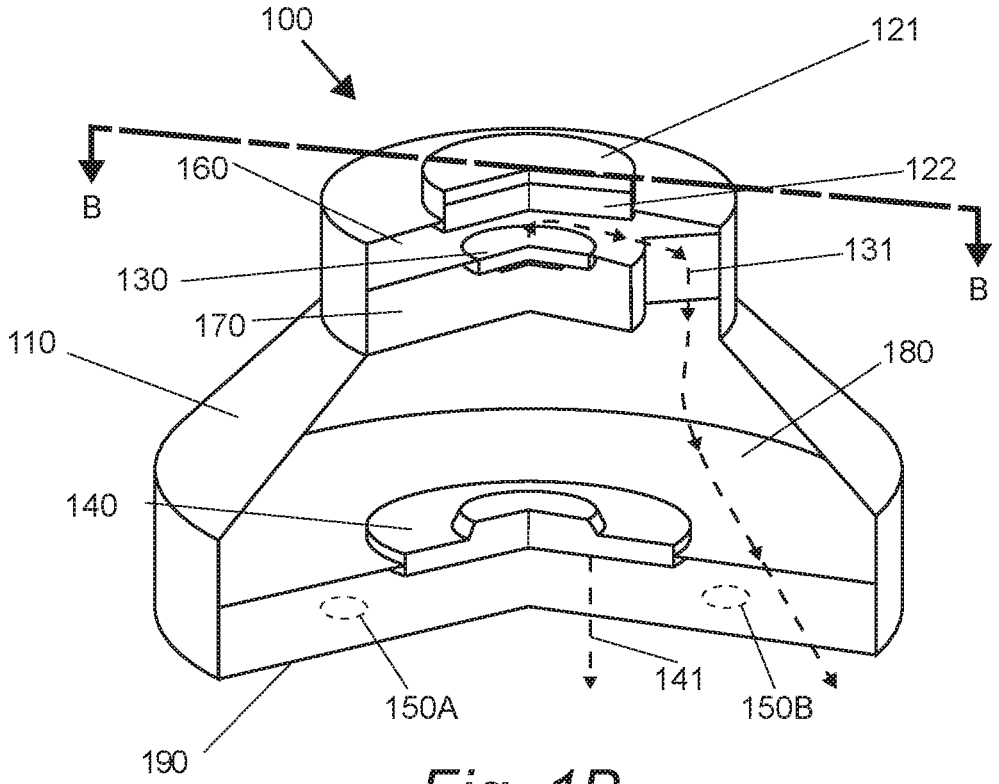
FIG. 1B is a cross-sectional view of the embodiment in FIG. 1A, along line A-A.
Figure 1C:
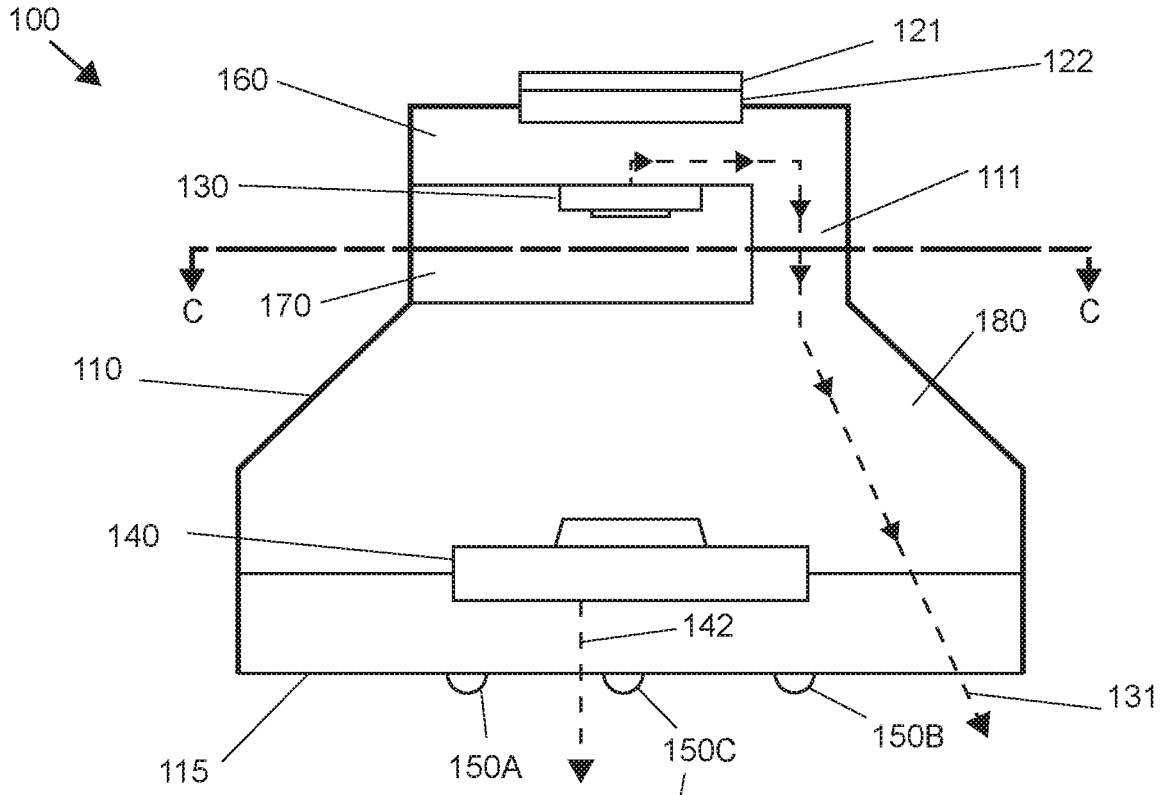
FIG. 1C is a cross-sectional view of the embodiment in FIG. 1B, along line B-B.
Figure 1D:
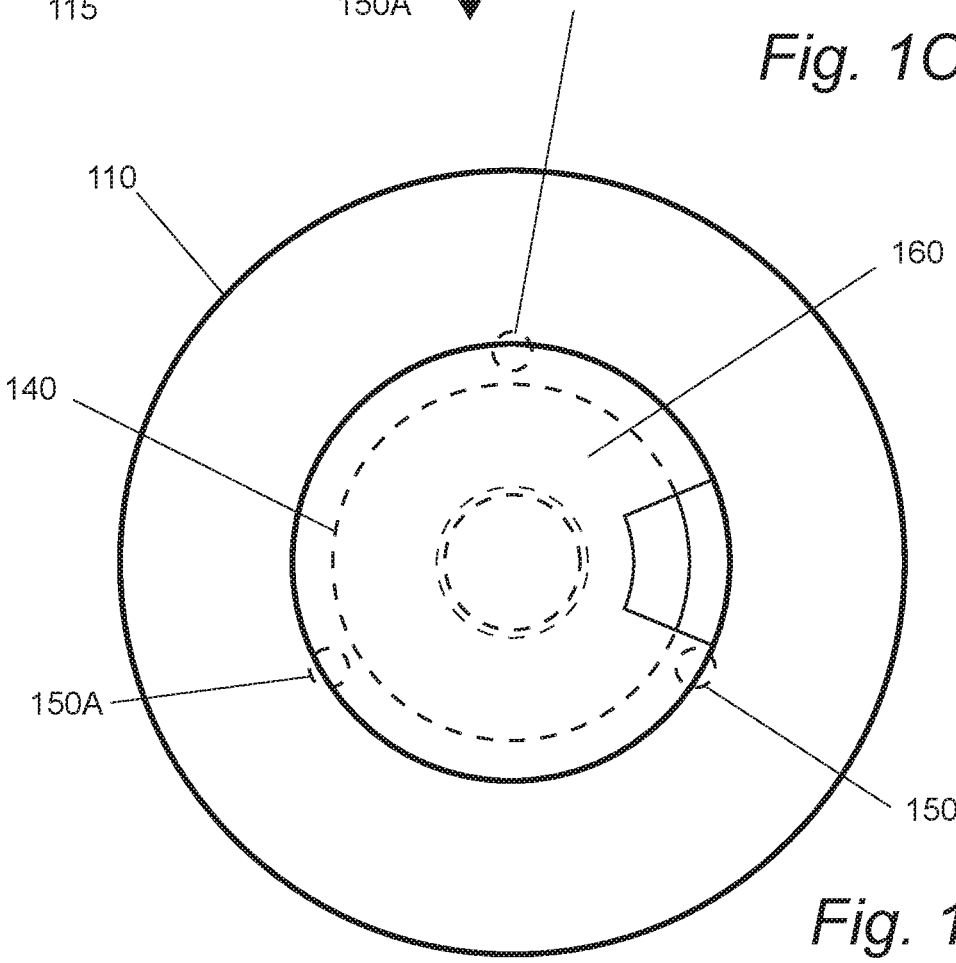
FIG. 1D is a cross-sectional view of the embodiment in FIG. 1C, along line C-C.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

Throughout the following discussion, numerous references will be made regarding servers, services, interfaces, engines, modules, clients, peers, portals, platforms, or other systems formed from computing devices. It should be appreciated that the use of such terms, is deemed to represent one or more computing devices having at least one processor (e.g., ASIC, FPGA, DSP, x86, ARM, ColdFire, GPU, multicore processors, etc.) programmed to execute software instructions stored on a computer readable tangible, non-transitory medium (e.g., hard drive, solid state drive, RAM, flash, ROM, etc.). For example, a server can include one or more computers operating as a web server, database server, or other type of computer server in a manner to fulfill described roles, responsibilities, or functions. One should further appreciate the disclosed computer-based algorithms, processes, methods, or other types of instruction sets can be embodied as a computer program product comprising a non-transitory, tangible computer readable media storing the instructions that cause a processor to execute the disclosed steps. The various servers, systems, databases, or interfaces can exchange data using standardized protocols or algorithms, possibly based on HTTP, HTTPS, AES, public-private key exchanges, web service APIs, known financial transaction protocols, or other electronic information exchanging methods. Data exchanges can be conducted over a packet-switched network, the Internet, LAN, WAN, VPN, or other type of packet switched network.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

FIG. 1 provides an illustration of a sound emitting device 100 according to embodiments of the inventive subject matter. FIG. 1A is a perspective view of an embodiment of a sound emitting device 100. FIG. 1B provides a three-dimensional view of the device 100 of FIG. 1A, with a cutaway section along line A-A removed to display the internal components of the device 100. FIG. 1C is a cross-sectional view of the embodiment in FIG. 1B, along line B-B. FIG. 1D is a cross-sectional view of the embodiment in FIG. 1C, along line C-C.

As shown in FIG. 1, the device 100 includes a housing 110, a first chamber 160, a second chamber 170, and a third chamber 180 disposed inside the housing 110, a first sound driver 130, a second sound driver 140, a sound outlet 190, and light sources 150A-C. The device 100 of FIG. 1 also includes a battery 122 for powering the device 100, and electronics 121 through which the signals are received that are processed and output by the device 100 in the form of sound waves traveling along paths 131 and 141. In preferred embodiments, sound chamber 170 is on the back of the first driver 130.

Preferably, the volume of the second chamber 170 is between 1.5 and 1.7 times the volume of the first isobaric chamber 160, inclusive. More preferably, the volume of the second isobaric chamber 170 is between 1.55 and 1.66 times the volume of the first isobaric chamber 160, inclusive. In even more preferably embodiments, the volume of the second isobaric chamber 170 is between 1.6 and 1.64 times the volume of the first isobaric chamber 160, inclusive.

Preferably, the volume of the third chamber 180 is between 1.5 and 1.7 times the volume of the second isobaric chamber 170, inclusive. More preferably, the volume of the third isobaric chamber 180 is between 1.55 and 1.66 times the volume of the second isobaric chamber 170, inclusive. In even more preferably embodiments, the volume of the third isobaric chamber 180 is between 1.6 and 1.64 times the volume of the second isobaric chamber 170, inclusive.

It is contemplated that there are internal components (e.g., batteries and Printed Circuit Board, etc.) that also fit inside of one of more isobaric chambers. The volume of an isobaric chamber does not include the space occupied by these internal components. In preferred embodiments, the first 160 and second 170 isobaric chambers, and the first sound driver 130 are enclosed within a housing 110 sized and dimensioned to fit within a human ear canal. In especially preferred embodiments, the first isobaric chamber 160 has a volume of no more than 7 cc, and the first sound driver 130 is no larger than 70 mm in diameter.

During operation, the first sound driver 130 emits sound waves along path 131 into the first chamber 160, to the third sound chamber 180, and then to the sound outlet 190. The second sound driver 140 emits sound waves traveling along path 141 to the sound outlet 190. The first chamber 160 is connected to the third chamber 180 via an air channel 111, that fluidly couples the first 160 and third 180 isobaric chambers. In preferred embodiments, the air channel 111 has an aspect ratio between 14 to 1 and 12 to 1, inclusive, and resonates at a native frequency.

In some embodiments, the device 100 has a circuitry configured to receive information, and use the received information to drive a light source 150A-C. In preferred embodiments, the light source 150A-C is a laser configured to emit light at between 640 nm and 660 nm, inclusive. It is contemplated that the circuitry can be configured to receive the information from a wired or wireless connection. The light source 150A-C can be light emitters configured to emit light waves using a pattern of pulses having a frequency between 0.1 Hz and 50 Hz. In especially preferred embodiments, the pattern of pulses can be based upon frequencies included within information used to drive the first sound driver 130.

Figure 2:
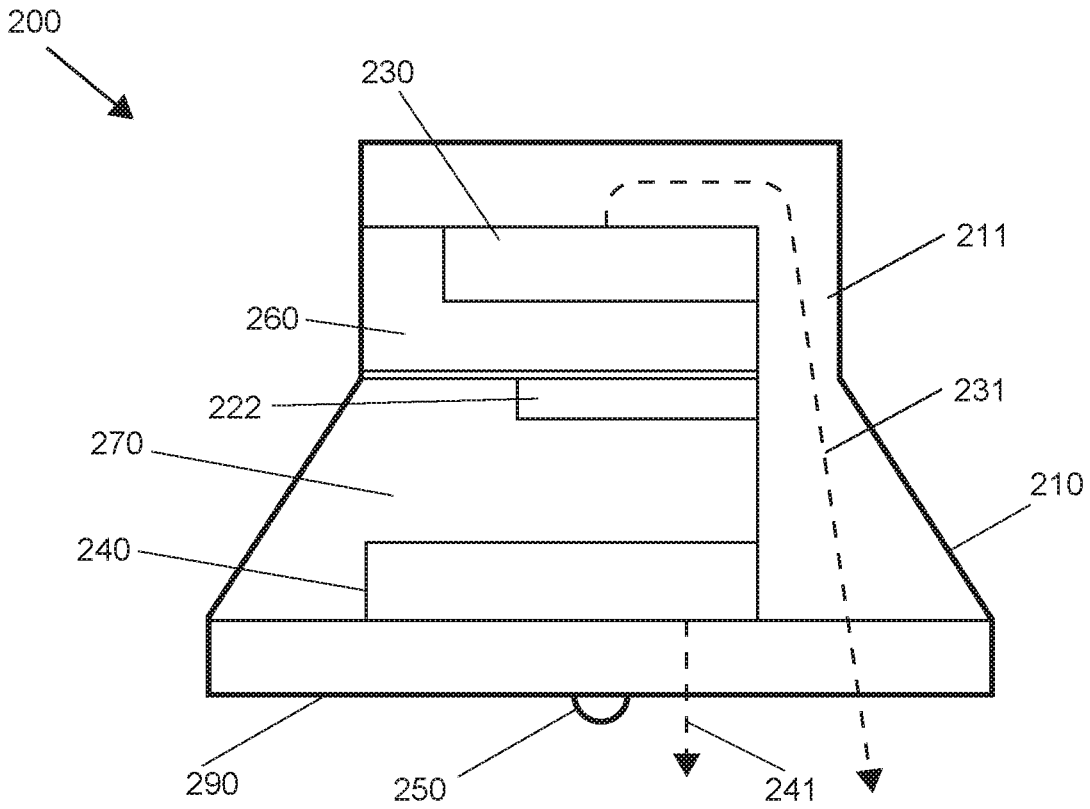
FIG. 2 is a cross-sectional view of another embodiment of a speaker with multiple isobaric chambers.

FIG. 2 provides an alternative embodiment of the system of the inventive subject matter. In FIG. 2, the device 200 includes, a housing 210, a first sound chamber 260, a second sound chamber 270, a first sound driver 230, a second sound driver 240, a sound outlet 290, a light source 250, and a battery 222 for powering the device 200. The first speaker 230 emits sound waves traveling along path 231, and second speaker 240 emits sound waves traveling along path 241. Preferably, the first speaker 260 has a diameter between 35 and 45 mm, and the second speaker 270 has a diameter between 45 and 55 mm.

Preferably, the volume of the second chamber 270 is between 1.5 and 1.7 times the volume of the first isobaric chamber 260, inclusive. More preferably, the volume of the second isobaric chamber 270 is between 1.55 and 1.66 times the volume of the first isobaric chamber 260, inclusive. In even more preferably embodiments, the volume of the second isobaric chamber 270 is between 1.6 and 1.64 times the volume of the first isobaric chamber 260, inclusive. In this alternative embodiment, the air channel 211 fluidly couples the first speaker 260 with the sound outlet 290. The port 211 is not fluidly coupled with the second sound chamber 270.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A sound emitting device, comprising:

a first isobaric chamber having a first volume;

a second isobaric chamber having a second volume that is between 1.5 times and 1.7 times the first volume;

a third isobaric chamber;

an air channel that fluidly couples the first and third isobaric chambers;

a first sound driver that emits sound into the first isobaric chamber; and wherein the first isobaric chamber has a volume of no more than 7 cc, and the first sound driver is no larger than 70 mm in diameter.

2. The sound emitting device of claim 1, wherein the third isobaric chamber has a third volume that is between 1.55 times and 1.66 times the second volume, inclusive.

3. A sound emitting device, comprising:

a first isobaric chamber having a first volume;

a second isobaric chamber having a second volume that is between 1.5 times and 1.7 times the first volume;

a third isobaric chamber having a third volume that is between 1.55 times and 1.66 times the second volume, inclusive;

a first sound driver that emits sound into the first isobaric chamber; and wherein the first isobaric chamber has a volume of no more than 7 cc, and the first sound driver is no larger than 70 mm in diameter.

4. The sound emitting device of claim 3, further comprising an air channel that fluidly couples the first and third isobaric chambers.

* * * * *